US008011020B2

(12) United States Patent
Vereen

(10) Patent No.: US 8,011,020 B2
(45) **Date of Patent: *Sep. 6, 2011**

(54) BREATHABLE, VENTED, FLAME-RESISTANT SHIRT

(75) Inventor: William Vereen, Thomasville, GA (US)

(73) Assignee: Riverside Manufacturing Co., Moultrie, GA (US)

( * ) Notice: Subject to any disclaimer, the term of this patent is extended or adjusted under 35 U.S.C. 154(b) by 42 days.

This patent is subject to a terminal disclaimer.

(21) Appl. No.: 12/545,344

(22) Filed: Aug. 21, 2009

(65) Prior Publication Data

US 2010/0043116 A1 Feb. 25, 2010

(51) Int. Cl.
*A41D 13/00* (2006.01)

(52) U.S. Cl. ..... 2/69; 2/81; 2/92; 2/97; 2/108

(58) Field of Classification Search ..... 2/69, 122, 2/81, 88, 92, 97, 108, 106, 115
See application file for complete search history.

(56) References Cited

U.S. PATENT DOCUMENTS

| | | | | |
|---|---|---|---|---|
| 2,084,173 | A | 6/1937 | Wexler | |
| 5,168,580 | A | 12/1992 | Foo | |
| 5,704,064 | A | 1/1998 | Van Der Sleesen | |
| 5,783,277 | A * | 7/1998 | Rock et al. | 428/86 |
| 7,578,005 | B2 * | 8/2009 | Vereen | 2/69 |
| 2004/0107473 | A1 * | 6/2004 | Jones et al. | 2/69 |

* cited by examiner

*Primary Examiner* — Khoa D Huynh
*Assistant Examiner* — Alissa J Tompkins
(74) *Attorney, Agent, or Firm* — Smith, Gambrell & Russell

(57) ABSTRACT

A flame-resistant shirt is described that has vents to facilitate heat release and air circulation while preserving flame-resistant qualities. The shirt has a standard front half, but a back half which includes a cape portion with openings to provide ventilation across the wearer's back.

20 Claims, 3 Drawing Sheets

| Client: | Description: |
| --- | --- |
| Arcwear.com | Electrical arc exposure of safety harness on mannequins, ASTM F887<br><br>A: FR cotton shirt, side vented with mesh<br>B: FR cotton shirt, back vented with mesh |

Mannequin A
Ei = 7.86 Cal/cm²

Mannequin B
Ei = 10.19 Cal/cm²

BREATHABLE, VENTED, FLAME-RESISTANT SHIRT

STATEMENT OF RELATED APPLICATIONS

This application is based on and claims priority on U.S. patent application Ser. No. 11/401,617 having a filing date of 11 Apr. 2006.

FIELD OF THE INVENTION

This invention is directed to a flame-resistant shirt having vents to facilitate heat release and air circulation while preserving flame-resistant qualities.

BACKGROUND OF THE INVENTION

Heat exchange between the body and the environment is affected by a wearer's clothing, which can limit convective and evaporative cooling. One solution to this problem is to incorporate a ventilation system within the clothing which encourages cooling. Ventilation can occur when air moves through the fabric itself, through clothing openings such as the neck, closures, and arm openings, and through vents strategically placed in the clothing to maximize airflow.

When performing physical work, a wearer's body generally produces excess heat. This increased heat production is diminished in part while the work is being performed due to motion-induced wind and increased convection inside a garment. This effect, however, cannot compensate entirely for increases in body heat produced during activity. Modification of the wearer's garment in such as way as to reduce both excess body and environmental heat facilitates both comfort and job performance.

In industries involving biological, chemical, or physical hazards, special protective clothing must be worn as a barrier to shield wearers from physical harm. Such protective clothing, however, may present another hazard by reducing a wearer's ability to dissipate heat through sweat evaporation. The combination of physical stress, environmental heat, and additional protective layers of clothing may cause an excessive level of heat stress to a wearer, which is both physically dangerous for the wearer and may, at a minimum, cause reduced physical work performance.

In addition to physical stress and environmental heat, electrical industry workers can be exposed to electrical arc flashes, which include radiant energy, convective energy, and conductive energy, with potential to cause severe injury. Burns resulting in death or requiring lengthy rehabilitation have occurred when workers have been exposed to an electrical arc. Many of these burns have been further complicated by ignition, melting and continued burning of non-flame resistant materials or non-arc resistant materials.

Utility maintenance workers, such as linemen, are subject to sudden intense electrical arc flashes and are required to wear flame-resistant clothing, including flame-resistant shirts, in an attempt to protect themselves from these hazards. Most flame-resistant shirts are made of relatively heavy, impermeable fabric and cause retention of body heat. Heat stress and perspiration can increase these risks to the wearer.

Other efforts to address these problems have involved lightweight fabrics made from exotic blends of fibers including aramid and carbonized fibers. These fabrics are costly, and while lighter weight, offer a lesser degree of protection, exist in limited color selections, and may degrade more readily in sunlight and ultraviolet rays than comparable grades of more common flame-resistant fabrics. It is also common in the electrical industry to layer two shirts with the heaviest, flame-resistant shirt on top, in order to combat moisture buildup from perspiration. This solution, however, also leads to the accumulation of excessive body heat because the moisture level of the inner air gap between the two layers becomes saturated and unable to support further evaporative cooling.

Vented shirts are known in the art, but conventional vented shirt designs are usually not compatible with flame-resistant requirements. For example, the vented shirt described in U.S. Pat. No. 4,608,715 incorporates a zippered side vent near each sleeve seam. When a zipper is opened, a series of vent holes is exposed and allows radiant heat of an arc to pass directly through the vent and holes to the wearer.

This conventional vent design and many others are not suitable for wearers who are subjected to sudden, intense electrical arc flashes because zippers, rivets, snaps, eyelets and other closures may subject a wearer to burns and other injury. They also can conduct heat and electricity and provide a route through a protective garment by which heat and electricity may pass. Further, mesh or webbing incorporated into the venting of conventional designs was not flame resistant, and would melt and cause injury upon exposure to an electrical arc. Also, conventional meshes are characteristically flat and open, leaving skin poorly covered and thus potentially exposed to heat and burns during an electrical arc flash. This makes the construction of a flame-resistant, ventilated shirt particularly challenging. The incorporation of specialty flame-resistant zippers, for example, is prohibitively expensive. Likewise, the incorporation of other specialty flame-resistant closures, like hook and loop material, are not only expensive, but cause damage to mesh and other fabric, and lose their ability to properly close over time. Damage to the fabric caused by closure notions can lead to increased hazards to a wearer.

Front venting of flame-resistant shirts further presents the problem of snagging as a worker climbs and grapples in the course of performing his or her job, and may potentially create a direct linear path along which harmful electrical arcs can travel from the environment, through the garment, to the wearer. For all the foregoing reasons, the end product of these approaches results in shirts that are less protective (even dangerous), more expensive, and undesirable in appearance compared to a conventional shirt.

The present invention addresses these problems by using readily available, moderately priced flame-resistant fabrics and unique construction techniques. The unique construction comprises several elements, namely a standard front half, but incorporating a side or back-caped vent (or both). One embodiment includes strategically positioned ventilation eyelets to increase air flow without diminishing protection. These unique features achieve greater ventilation while being constructed in a manner and of materials to ensure compliance with applicable standards and regulations (ASTM F1506, NFPA 70E, and the apparel requirements of 29 CFR 1910.269). The front half of the shirt is made using a flame-resistant fabric with a standard design, and does not have to be specially made, which reduces the total cost of manufacturing.

The back half of the shirt incorporates vent openings which are uniquely made and located so that the wearer is not exposed to radiant heat through the openings in the event of an electrical arc exposure that is within the arc-rated capacity of the shirt. A ventilating panel made from a fabric which allows the circulation of air, like a mesh, knit, or moisture-wicking material, allows maximum air circulation through the vents while providing increased protection to a wearer from electrical arc flashes. Prior art shirt constructions with "ventilated panels" typically incorporated open-holed or very loosely knit, "two-dimensional" (flat) nylon or polyester mesh, through which the radiant energy of an electrical arc might pass, and which are unsafe in the electrical industry. Further, shirt constructions which would allow mesh, knit, or other ventilated panels to be visible from the outside of the shirt are typically not safe in environments with electrical arc exposures.

In one embodiment of the present invention, the ventilating panel is constructed from a mesh knit. Ideally, the mesh knit is dimensional (not flat) so that holes in the mesh appear to be open when viewed from the front, but from a side view, the holes appear to be somewhat, or completely, closed. The mesh knit is flame-resistant to provide additional protection to a wearer. For example, flame-resistant meta-aramid material or material exhibiting similar construction and flame-resistant properties may be used. Advantageously, a mesh knit in accordance with the present invention can shield the body of a wearer, and any non-flame-resistant undershirt or undergarments of the wearer, from the harmful effects of radiant and convective heat radiation of an electrical arc exposure.

In another embodiment of the present invention, the ventilating panel is constructed from a lightweight or a midweight knit fabric. The lightweight or midweight knit fabric can have moisture-wicking properties. This embodiment is ideal for wearers who desire a solid ventilating panel rather than a panel containing mesh "holes." Lightweight or midweight moisture-wicking knit fabrics are available with flame-resistant qualities to provide additional protection to a wearer.

In yet another embodiment of the present invention, the ventilating panel is constructed from heavyweight knit fabric for vent protection plus additional wearer protection from layering. This embodiment of the vented, flame-resistant shirt is able to withstand greater exposures to which the shirt may be subjected, and is ideal for a wearer working in more hazardous situations. Flame-resistant fabrics, such as those made with modacrylic fibers, can be chosen depending upon the desired durability, performance, and ability to extinguish flames. Heavyweight moisture-wicking knit fabrics are also available with flame-resistant qualities to provide additional protection to a wearer.

In still other embodiments of the present invention, the ventilating panel can comprise, but is not limited to, blended or unblended flame-resistant fabrics, including generic flame-resistant tricot warp knit mesh made from blends such as carbonized, modacrylic fibers, para-meta- or other aramid fibers, or flame-resistant treated natural fibers. Some level of non-flame-resistant fiber may be incorporated into an embodiment of the present invention, so long as the fabric would ultimately be flame-resistant. Examples of some suitable fabrics include NOMEX®, DRIFIRE® Tubular jersey knit, and INDURA® ULTRASOFT®, TECGEN®, TWARON®, PROTEX®, and KEVLAR®. Moisture wicking properties can add an additional element of comfort for a wearer.

It is therefore the object of the present invention to provide a flame-resistant shirt that uses readily available flame-resistant fabrics, has a standard front half, and a vented back half, which provides ventilation without compromising the flame-resistant quality.

These features, and other features and advantages of the present invention will become more apparent to those of ordinary skill in the relevant art when the following detailed description of the preferred embodiments is read in conjunction with the appended drawings in which like reference numerals represent like components throughout the several views.

BRIEF SUMMARY OF THE INVENTION

A flame-resistant shirt in accordance with the present invention is constructed entirely of flame-resistant materials. The front half of the shirt is of a standard design, having no vent openings or other unusual features. The back half has a cape portion that is stitched to and extends downwardly from the shoulder yoke and may be open at the side, bottom or both, except for strategically-placed thread tacking, to keep the cape from blousing. Beneath the cape portion is a ventilating panel, which extends downwardly from the shoulder yoke parallel to the cape portion. Vent openings or ventilation eyelets are formed adjacent the sleeve seams.

Air can enter through the vent openings or ventilation eyelets, and circulate across the wearer's back, dispersing body heat through the ventilating panel, to the open side or bottom vents of the cape portion. Air can also enter through the vent openings or ventilation eyelets, pass through the ventilating panel, and circulate underneath the fabric of the shirt.

DETAILED DESCRIPTION OF THE DRAWINGS

Reference will now be made in detail to the present embodiments of the invention, as illustrated in the accompanying drawings.

Figure 2:
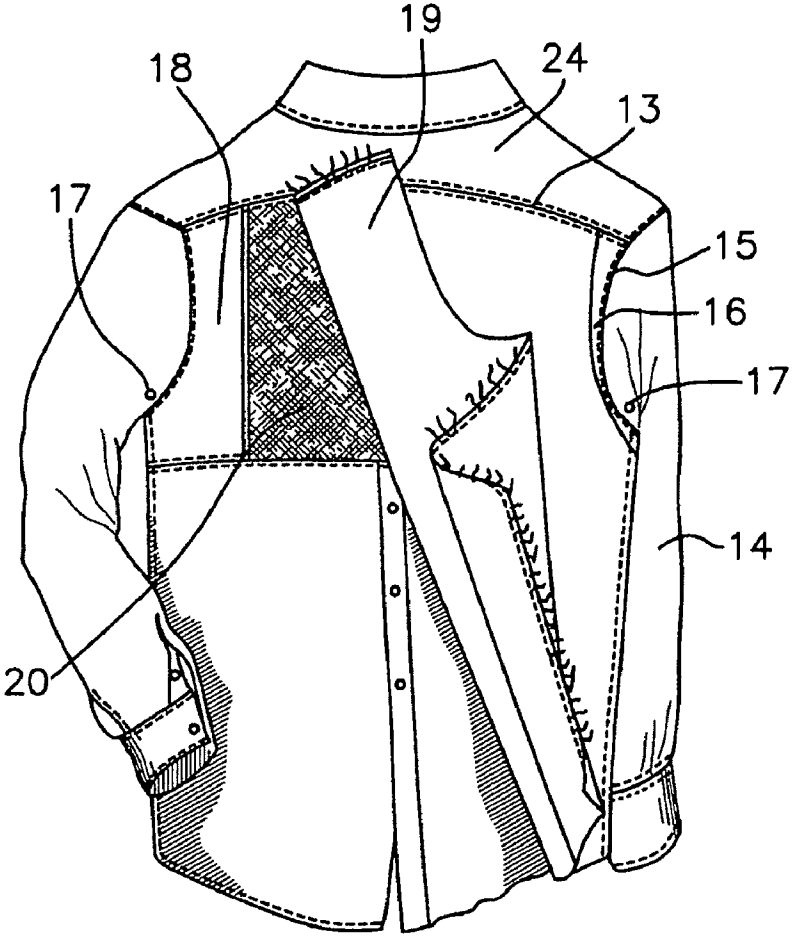
FIG. 2 is a rear perspective view of the shirt, partially disassembled to illustrate its inner layers.
Figure 1:
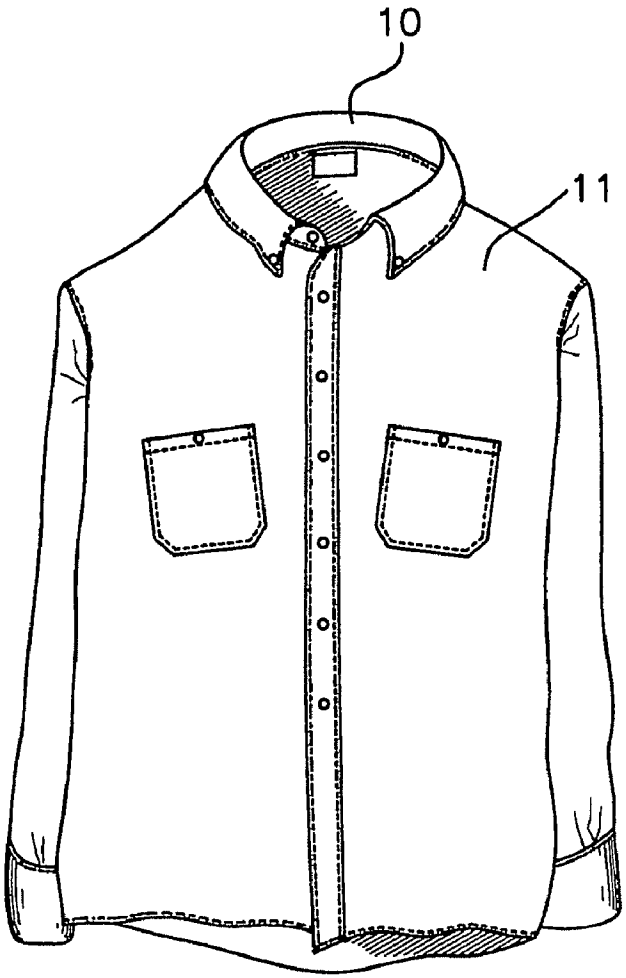
FIG. 1 is a front perspective view of the shirt.

FIG. 1 illustrates a shirt 10 made of a flame-resistant fabric. The front half 11 of the shirt 10 is of a standard shirt front design. The back half of shirt 10 is illustrated in FIG. 2. The cape portion 19 is stitched to and extends downwardly from the shoulder yoke 24, at yoke seam 13. Also stitched to and extending downwardly from yoke seam 13 is the ventilating panel 20 which is entirely covered by the cape portion 19. The ventilating panel 20 is made from a blended or unblended flame-resistant material, such as a mesh or a light or heavyweight knit or a flame-resistant treated natural fiber, and extends between inner panels 18 which can be made from the same flame-resistant fabric as cape portion 19, but in any case the inner panels 18 are comprised of a fabric that has fire-resistant properties exceeding that of the fabric used for the ventilating panel 20.

The offset inner panels 18 provide added protection to a wearer in an effort to avoid the direct exposure of an electrical arc to the ventilating panel 20, and to increase the overall safety of the vented shirt 10 design. The inner panels 18 are adjacent to a right and left sleeve 14, and are attached at sleeve seams 15 to sleeves 14. The ventilating panel 20 does not offer maximum protection against infrared rays from electrical arc events and must be protected from direct exposure to the radiant energy of an electrical arc. The inner panels 18 move the ventilating panel 20 away from the sleeve openings in an effort to avoid exposure of the ventilating panel 20 to electrical arc flashes. If the inner panels 18 were not used, the ventilating panel 20 would extend to the sleeve seam 15 and would not provide adequate protection to a wearer. In addition, without inner panels 18, a wearer's skin or a t-shirt worn under shirt 10 could be exposed, which could lead to ignition and burns.

Vent openings 16 are formed by the gap between the cape portion 19 and the inner panels 18. Ventilation eyelets 17 are formed adjacent the sleeve seam 15, using a flame-resistant thread such as NOMEX®. In one embodiment, the ventilation eyelets 17 are located on the sleeves 14 themselves adjacent the armpit of a wearer or very near the sleeve seam 15 to provide additional vent openings 16, allowing air to further circulate from side to side across the back of the wearer. The ventilation eyelets 17 can also be located on the front half 11 or the back half of the shirt 10 adjacent the sleeve seam 15. It is preferable that the ventilation eyelets 17, are located sufficiently near the armpit region of a wearer so that when the shirt 10 is in use access through the ventilation eyelets 17 to a wearer's skin is protected from direct exposure to electrical arc flashes.

In order to determine the impacts of an electrical arc on the flame-resistant qualities of the vented shirt design of the present invention, two embodiments of a vented, flame-resistant shirt designed in accordance with the present invention were tested in a laboratory. These tests were conducted using the test setup of ASTM F1958-1999 Standard Test Methods for Determining the Ignitability of Non-flame-Resistant Materials for Clothing by Electric Arc Exposure Method Using Mannequins. This method allows for the testing of actual garments for evaluation of ignition and melting.

The conditions of the test included a controlled electrical arc source, flame-resistant mannequins, and instrumented monitor sensors with a 100 MVA supply. The current was fed through a co-axial circuit to the electrodes, which were enclosed in a modified Faraday cage to minimize the effects of magnetic fields on the directionality of the electrical arc. The apparatus was enclosed in a test cell to minimize any potential effects of outside elements on the results. The fault current, the duration of the electrical arc, the arc length, and the test specimen distance from the arc were set for each test. The current offset was controlled by point on wave switching of the 60 Hz supply, which is controlled within 0.01 cycles. Monitor sensors on each side of the mannequins measured the incident energy (Ei) for Mannequins A and B. The temperature rise of the sensors was evaluated using the recorded data and visual observations.

Figure 5:
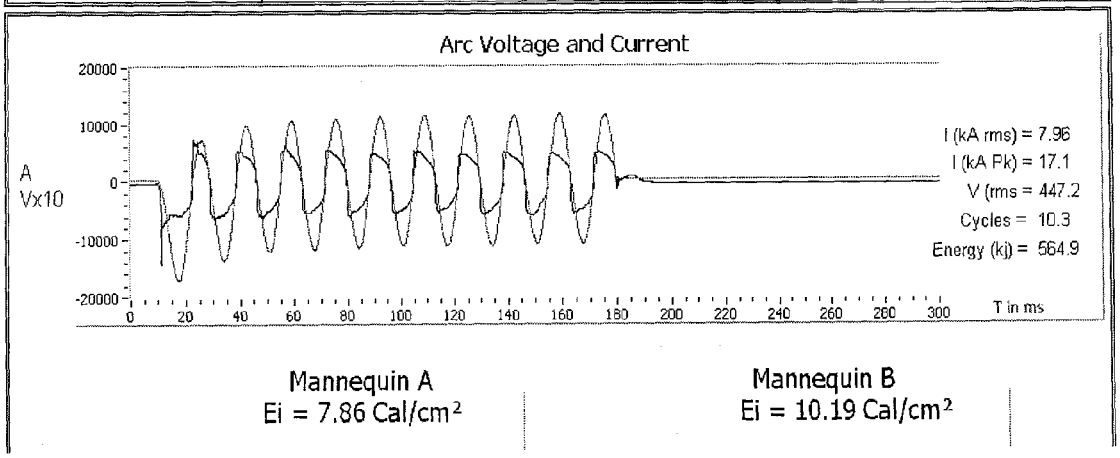
FIG. 5 is a flow chart showing arch voltage and current.

Arc voltage, current, duration, energy, and the temperature rise for each sensor are shown in FIG. 5 below, where Mannequin A exhibits results for the back of a shirt with a side-vented embodiment, and Mannequin B exhibits results for the back of a shirt with a back vented embodiment.

During the testing, a t-shirt was placed under the flame-resistant shirts 10 according to the present invention and an electrical arc was directed toward the back portion of the flame-resistant shirts 10 in an effort to determine whether the exposure would scorch the t-shirt through the vents. The test results revealed that both embodiments of the vented shirt 10 designed in accordance with the present invention yielded unscorched rear shirt portions with an exposure of 8-10 cal/cm2. Thus, the design increased the protection of a wearer from electrical arc injury from scorching or ignition in the event of a rear exposure.

Figure 4:
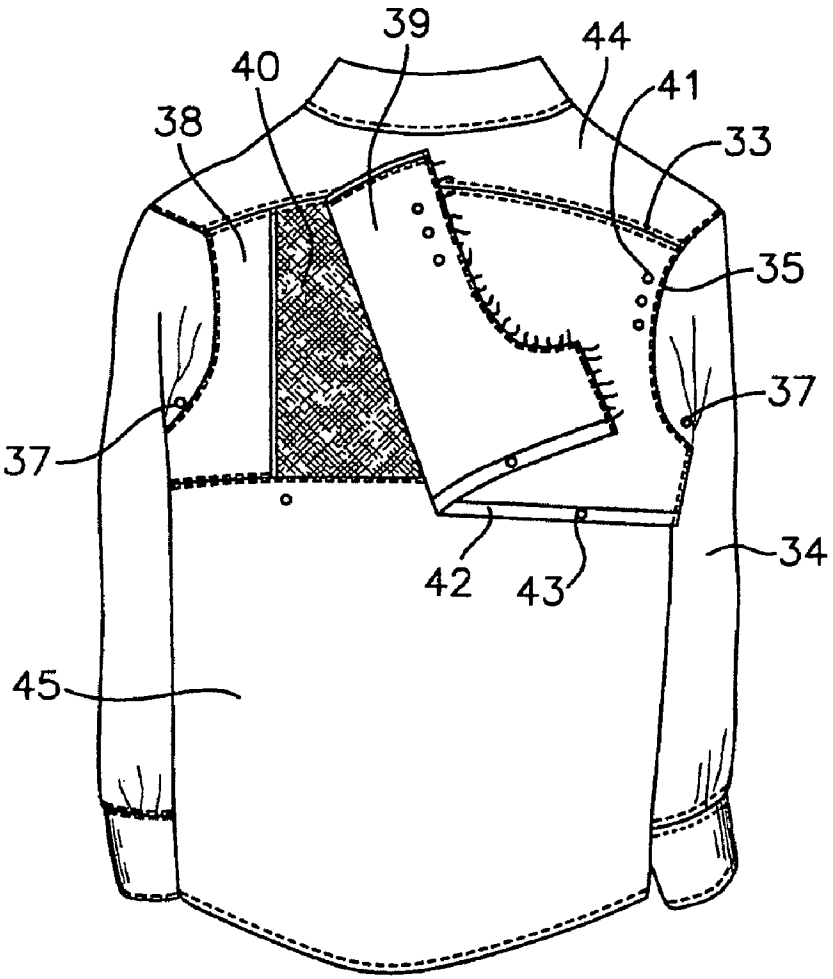
FIG. 4 is a rear perspective view of the shirt of FIG. 3, partially disassembled to illustrate its inner layers.
Figure 3:
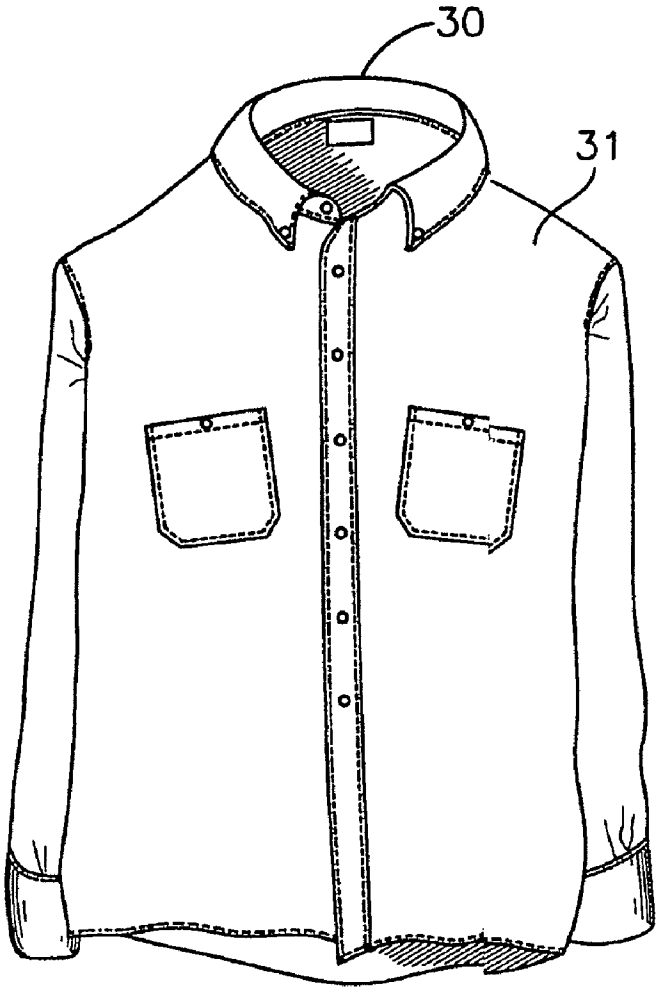
FIG. 3 is a front perspective view of an alternate shirt design.

FIG. 3 illustrates an alternative shirt 30 made of a flame-resistant fabric. The front half 31 is of a standard shirt front design. The back half of shirt 30 is illustrated in FIG. 4. The cape portion 39 is stitched to and extends downwardly from the shoulder yoke 44, at the yoke seam 33. Also stitched to and extending downwardly from the yoke seam 33 is the ventilating panel 40. The ventilating panel 40 extends between the offset inner panels 38 which can be made from the same flame-resistant fabric as cape portion 39, but in any case the inner panels 38 are comprised of a fabric that has fire-resistant properties exceeding that of the fabric used for the ventilating panels 40. The ventilating panel 40 is made from flame-resistant materials such as a mesh or a light or heavyweight knit or a blended or unblended flame-resistant fabric or flame-resistant treated natural fibers, and extends between inner panels 38.

The inner panels 38 are attached at sleeve seams 35 to sleeves 34, and provide added protection to a wearer in an effort to avoid direct exposure to an electrical arc through the ventilating panel 40, and to increase the overall safety of the vented shirt 30 design. Ventilation eyelets 37 are formed adjacent to sleeve seams 35, using a flame-resistant thread such as NOMEX®. Additional ventilation eyelets 41 are formed on each edge of cape portion 39. The bottom panel 45 is stitched to and extends downwardly from ventilating panel 40 and its adjacent inner panels 38, which are offset for safety as described herein. The inner panels 38 allow ventilation spaces to exist in the outer fabric layer that could not exist if the ventilating panel 40 was not offset by the inner panels 38. Ventilation eyelets 37 enhance the functioning of the shirt 30 because they allow heat to escape as it rises into the top of the cape portion 39. The number of ventilation eyelets 37 can increase or any number of ventilation eyelets 37 can be made larger to allow for additional air circulation because the inner panels 38 serve the function of protecting the ventilating panel 40 from direct infrared exposure. If the shirt 30 were constructed in such a way as to have the ventilation eyelets 37 leading directly to the ventilating panel 40 (and if inner panels 38 were not employed), this construction would provide direct access for infrared radiation and could lead to burns or increased ignition hazards from t-shirts or other undergarments. The bottom end of cape portion 39 is open (not stitched or otherwise fastened) to allow for increased air circulation. However, fold 42 may be incorporated into the bottom edge of cape portion 39 by tacking the bottom edge at tack points 43 to keep the cape portion from billowing excessively or becoming displaced. The tack points 43 are secured with a flame-resistant thread.

The foregoing detailed description of the preferred embodiments and the appended figures have been presented only for illustrative and descriptive purposes and are not intended to be exhaustive or to limit the scope and spirit of the invention. The embodiments were selected and described to best explain the principles of the invention and its practical applications. One of ordinary skill in the art will recognize that many variations can be made to the invention disclosed in this specification without departing from the scope and spirit of the invention.

What is claimed is:

1. A shirt constructed of flame-resistant material comprising a front half, a back half, and a sleeve on each side of the shirt, the back half including:

a shoulder yoke of flame-resistant material extending between said sleeves of flame-resistant material, a cape portion of flame-resistant material extending downwardly from said shoulder yoke and between said sleeves and having a width, at least one ventilation opening positioned at or near at least one side edge of the cape portion, at least two separate inner panels positioned beneath the cape portion and at least one inner panel extending from at least one edge of the sleeve adjacent the at least one ventilation opening near the at least one side edge of the cape portion toward the center of said back half, and a ventilating panel, fixed to and between the at least two separate inner panels, and extending downwardly from said shoulder yoke, beneath said cape portion, parallel thereto, and having an entire width less than the width of the cape portion, wherein the cape portion and the at least two separate inner panels overlap only at the edges of the cape portion so that the overlapping cape portion and the at least two separate inner panels protect the ventilating panel from the direct exposure of to an electrical arc through the ventilation opening, and wherein said ventilating panel is not completely covered by said at least two separate inner panels.

2. The shirt of claim 1, wherein said cape portion is open at the bottom.

3. The shirt of claim 2, wherein said back half includes a lower panel that extends downwardly from said ventilating panel, wherein the cape portion overlaps the lower panel, and wherein the open bottom of the cape portion is partially constrained by one or more tacks to an adjacent lower panel.

4. The shirt of claim 1, wherein said sleeves have ventilation openings at or near their juncture with said cape portion.

5. The shirt of claim 1, wherein said ventilating panel comprises a three-dimensional mesh knit fabric.

6. The shirt of claim 5, wherein said three-dimensional mesh knit fabric is flame-resistant.

7. The shirt of claim 1, wherein said ventilating panel comprises a lightweight knit fabric.

8. The shirt of claim 7, wherein said lightweight knit fabric is flame-resistant.

9. The shirt of claim 8, wherein said lightweight knit fabric has moisture-wicking properties.

10. The shirt of claim 1, wherein said ventilating panel comprises a heavyweight knit fabric.

11. The shirt of claim 6, wherein said heavyweight knit fabric is flame-resistant.

12. The shirt of claim 11, wherein said heavyweight knit fabric has moisture-wicking properties.

13. The shirt of claim 1, wherein said ventilating panel comprises a flame-resistant treated natural fiber fabric.

14. The shirt of claim 13, wherein said fabric has moisture-wicking properties.

15. A shirt constructed of flame-resistant material comprising a front half, a back half, and a sleeve on each side of the shirt, the back half comprising a top half with a neck opening and a bottom half, said back half further including:

a shoulder yoke of flame-resistant material extending between said sleeves of flame-resistant material, a cape portion of flame-resistant material extending downwardly from said shoulder yoke and between said sleeves and having a width, at least one ventilation opening positioned at or near at least one side edge of the cape portion, at least two separate inner panels within only said top half positioned beneath the cape portion and extending from along at least one edge of the sleeve adjacent the at least one ventilation opening near a side edge of the cape portion toward the center of said back half, and a ventilating panel, fixed to and between the at least two separate inner panels, and extending downwardly from said shoulder yoke, beneath said cape portion, parallel thereto, and having an entire width less than the width of the cape portion, wherein the cape portion and the at least two separate inner panels overlap only at the side edges of the cape portion so that the overlapping cape portion and the at least two separate inner panels protect the ventilating panel from direct infrared exposure through the at least one ventilation opening, and wherein said ventilating panel is not completely covered by the at least two separate inner panels.

16. The shirt of claim 15, wherein said ventilating panel comprises a flame-resistant lightweight knit fabric.

17. The shirt of claim 15, wherein said ventilating panel comprises a flame-resistant heavyweight knit fabric.

18. A shirt constructed of flame-resistant material comprising a front half, a back half, and a sleeve on the right and left side of the shirt, the back half further including:

a shoulder yoke of flame-resistant material extending between said sleeves of flame-resistant material, a neck opening within said shoulder yoke with a seam having a left edge and a right edge, a cape portion of flame-resistant material extending downwardly from said shoulder yoke and between said sleeves and having a width, at least one ventilation opening positioned at or near at least one side edge of the cape portion, a ventilating panel, fixed to and extending downwardly from said shoulder yoke, beneath said cape portion, parallel thereto, and having an entire width less than the width of the cape portion, and two separate inner panels positioned beneath the cape portion, said first separate inner panel extending from an edge of the left sleeve and adjacent the at least one ventilation opening near an edge of the cape portion toward the center of said back half and terminating at approximately the left edge of said neck opening seam, and said second separate inner panel extending from an edge of the right sleeve and adjacent the ventilation opening near an edge of the cape portion toward the center of said back half and terminating at approximately the right edge of the neck opening, wherein the cape portion and the two separate inner panels overlap only at the edges of the cape portion so that the overlapping cape portion and the two separate inner panels protect the ventilating panel from direct infrared exposure through the at least one ventilation opening, and wherein said ventilating panel is not completely covered by said two separate inner panels.

19. The shirt of claim 18, wherein said ventilating panel comprises a flame-resistant lightweight knit fabric.

20. The shirt of claim 18, wherein said ventilating panel comprises a flame-resistant heavyweight knit fabric.

* * * * *